US005190060A

United States Patent [19]

Gerding et al.

[11] Patent Number: 5,190,060

[45] Date of Patent: Mar. 2, 1993

[54] SMOKABLE ARTICLE

[75] Inventors: Guillermo Gerding, Hamburg; Bernhard Hauser, Schenefeld; Knut Möller, Hamburg; Bernd-Henrik Müller, Hamburg; Gert Rudolph, Hamburg; Wolfgang Wiethaup, Hamburg, all of Fed. Rep. of Germany

[73] Assignee: B.A.T. Cigarettenfabriken GmbH, Hamburg, Fed. Rep. of Germany

[21] Appl. No.: 496,840

[22] Filed: Mar. 21, 1990

[30] Foreign Application Priority Data

Apr. 4, 1989 [DE] Fed. Rep. of Germany ..... 3910899

[51] Int. Cl.[5] ..... A24D 1/18

[52] U.S. Cl. ..... 131/194; 131/359; 131/369

[58] Field of Search ..... 131/194, 359, 369

[56] References Cited

U.S. PATENT DOCUMENTS 4,756,318 7/1988 Cleanman et al. ..... 131/194
4,771,795 9/1988 White ..... 131/194

FOREIGN PATENT DOCUMENTS 0264195 4/1988 European Pat. Off. .
1432618 10/1969 Fed. Rep. of Germany .
1185887 3/1970 United Kingdom ..... 131/194

*Primary Examiner*—V. Millin
*Assistant Examiner*—J. Doyle
*Attorney, Agent, or Firm*—Armstrong, Westerman, Hattori, McLeland & Naughton

[57] ABSTRACT

A smokable article having an aerosol generating zone connected to a mouthpiece via a tubular intermediate zone, wherein the aerosol generating zone includes an annular combustion element and a cylindrical carrier for an aerosol precursor coaxially disposed therewithin with a space therebetween forming air flow passages. Heat from the combustion element conducted to the aerosol carrier generates aerosols that may be drawn by air passing through the air flow passages to the mouthpiece by a smoker.

15 Claims, 2 Drawing Sheets

SMOKABLE ARTICLE

BACKGROUND OF THE INVENTION

1. Field of the Invention

The invention relates to a smokable article comprising an aerosol generating zone consisting of a combustion element and a carrier for an aerosol precursor which is connected for heat transfer to the combustion element and which is disposed in the center of the aerosol generating zone and coaxially surrounded by the combustion element, a mouthpiece, a cavity between the aerosol generating zone and the mouthpiece and at least one outer wrapper.

2. Description of the Prior Art

Such a smokable article is disclosed in European Patent Publication No. 0,264,195 and comprises an aerosol generating zone consisting of a combustion element and a carrier for an aerosol precursor connected for heat transfer to the combustion element, furthermore flow passages in the aerosol generating zone, a mouthpiece and at least one sheath or wrapper for the aerosol generating zone and the mouthpiece.

In this known smokable article the combustion element is disposed in the center of the aerosol generating zone and is surrounded coaxially by the tubular carrier for the aerosol precursor. Three longitudinal passages extend between the stack-like central combustion element and the tubular carrier for the aerosol precursor, which is formed by a substrate of ceramic fibres.

The advantage of this coaxial arrangement of inner combustion element and outer carrier for the aerosol precursor resides in the compact structure a disadvantage is, however, that the combustion element can only be ignited by means of an ignition cone, thereby increasing the production costs of this smokable article, as well as the unsatisfactory heat generation in the entire impregnated portion of the aerosol precursor carrier surrounding the combustion element.

SUMMARY OF THE INVENTION

The invention is therefore based on the problem of providing a smokable article of the specified category in which the aforementioned disadvantages do not occur. In particular a smokable article is to be proposed which in its appearance, in particular in the ignited state, resembles a conventional cigarette still more closely and can be more easily ignited and permits a better transfer of the aerosols formed into the inhaled volume flow.

The invention therefore proposes resides in a smokable article comprising an aerosol generating zone consisting of a combustion element and a carrier for an aerosol precursor which is connected for heat transfer to the combustion element and which is disposed in the center of the aerosol generating zone and coaxially surrounded by the combustion element, a mouthpiece, a cavity between the aerosol generating zone and the mouthpiece and at least one outer sheath, wherein the combustion element is surrounded externally coaxially by an insulating layer, in the aerosol generating zone flow passages are provided, the cylindrical carrier consists of a porous ceramic material which is impregnated with the aerosol precursor and the cylindrical carrier projects on the mouth end of the aerosol generating zone somewhat beyond the mouth end of the combustion element, at the most 10 mm.

Practical embodiments are defined by the features of the subsidiary claims.

The advantages achieved with the invention are based on a reversal of the structure known from DE-OS 0 264 195, i.e. the short carrier for the aerosol precursor is disposed in the center of the aerosol generating zone and is surrounded coaxially radially externally by the tubular combustion element. The flow passages necessary for the induction of the heated air are formed either by the porosity of the combustion element and/or of the carrier for the aerosol precursor or by maintaining a predetermined spacing between the outer surface of the carrier and the inner surface of the tubular combustion element so that the annular cavity thus formed can be used as flow passage. In addition, thermal radiation and conduction are utilized to form and vaporize the aerosols from the carrier for the aerosol precursors.

In the latter configuration, spacers are disposed between the carrier and the combustion element to hold the tubular combustion element at a predetermined distance from the surface of the carrier.

If this smokable article is ignited it has an appearance corresponding substantially to that of conventional cigarettes because the glow is located at the annular end face of the tubular combustion element and thus in the peripheral region of the aerosol generating zone; it is also easier to ignite the combustion element in this region; consequently an ignition cone is no longer necessary.

As a carrier for the aerosol precursors, substantially porous ceramic material impregnated with aerosol precursors or a capsule of metal or ceramic filled with an impregnated granulate can be used, said capsule being in thermally conductive connection with the inner wall of the combustion element, for example via webs/spacers and a free air flow simultaneously being permitted longitudinally through the flow passages thus formed. The spacers may be of metal or thermally conductive ceramic and are preferably made integrally as part of the wall of the aroma capsule. The aerosol precursor carrier as well as the substrate or granulate may consist at least partially of tobacco material.

Alternatively, the flow passages can also be formed by a corresponding surface structure of combustion element/carrier, for example by a corrugated or serrated outer or inner wall structure of combustion element and/or carrier.

A capsule filled with a granulate impregnated with aroma precursors should have at its mouth end at least one opening for the exit of the aerosols heated by the thermal conduction and radiation and thus finally vaporized out of the capsule to the mouth end of said smokable article.

According to a preferred embodiment however at least two openings are used, i.e. at least one opening for the free evaporation of the aerosol out of the capsule and at least one further opening for the air stream sucked through the capsule parallel to the combustion element.

The tubular combustion element should have through and/or blind flow passages, in particular bores, which extend from the ignition-side end into the interior of the combustion element so that air can also get into the interior of said element and thus support the burning of the combustion element.

To prevent the air heated at the combustion element from flowing only through the combustion element or the flow passages, according to a preferred embodiment for the variant with the porous ceramic carrier for the aerosol precursor an at least partial, in particular however complete, sealing/closure of the mouth-side cross-sectional area of the combustion element should be provided so that due to the flow deflection thereby resulting the hot air is constrained to flow out of the combustion element into the carrier for the aerosol precursor and thus necessarily through part of the carrier, the aromatic substances thereby forming, being entrained by the hot air and finally leaving the carrier.

To additionally promote this effect, according to a preferred embodiment, the carrier projects on the mouth side of the aerosol generating zone somewhat beyond the tubular combustion element; this "overhang" should at the most be 10 mm.

The aerosol generating zone must be separated from the mouthpiece in gas-permeable manner; for this purpose, between the aerosol generating zone and the mouthpiece a cavity may be provided which excludes direct contact between the combustion element and an adjoining tobacco filling and/or the mouthpiece.

According to a preferred embodiment the mouthpiece contains a filter material which may possibly be additionally ventilated. Possible materials for this purpose are in particular cellulose acetate or polypropylene.

If the cavity between the aerosol generating zone and the mouthpiece is to be filled with tobacco material, according to a preferred embodiment for this purpose, tobacco material of low packing density may be used. All possible variants of tobacco material may be used, including mixtures, for example ribbed or leaf cut tobacco, extruded tobacco materials, tobacco foils, biotechnically produced tobacco materials from cell cultures, possibly with increased active substance content, in particular nicotine, as well as other biotechnically produced plant or vegetable materials. Thus, from this tobacco material additional flavouring and active substances can be given up to the aerosol flowing through.

BRIEF DESCRIPTION OF THE DRAWINGS

The invention will be described in detail hereinafter with reference to examples of embodiments with the aid of the attached schematic drawings, wherein.

DESCRIPTION OF THE PREFERRED EMBODIMENTS

Figure 1:
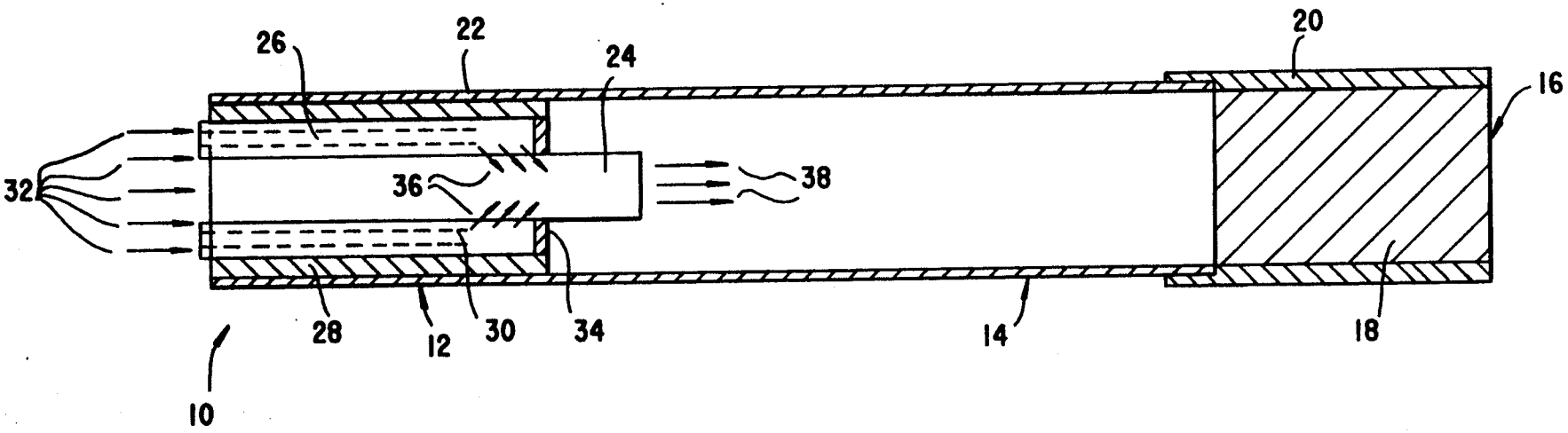
FIG. 1 shows in longitudinal section an overall view of a first embodiment of a smokable article.

The smokable article indicated generally by the reference numeral 10 in FIG. 1 has the basic structure known already from EP-OS 0 264 195, i.e. has three basic elements which are joined together to form the usual elongated cylindrical form of a conventional smokable, article, i.e. an aerosol generating zone 12, at the ignition and an intermediate zone 14 and a mouthpiece 16 at the mouth end.

The two basic regions 12 and 14 have a common outer sheath 22 which can consist of an air-impermeable paper, plastic, cardboard or an air-impermeable hollow cylinder of tobacco material or ceramic. Said sheath 22 thus extends from the ignition end, on the left in the illustration in FIG. 1, to the right end of the intermediate zone 14.

A tipping paper 20 serves to connect the mouthpiece 16 to the front portion of the smokable article 10, i.e. in particular to the right end of the intermediate piece 14.

In the embodiment illustrated in FIG. 1 the mouthpiece 16 is formed as a filter, i.e. filled with a filter material 18; for this purpose, in particular cellulose acetate or polypropylene may be used.

The intermediate zone 14 is either empty of filled with a tobacco material of low packing density; for this purpose any known possible material may be use, including mixtures of, for example, ribbed and/or leaf cut, extruded tobacco material, tobacco foil, biotechically produced tobacco materials from cell cultures, possibly with increased active substance content, in particular nicotine, but also other biotechnically produced plant material. The aerosol flowing through can thus be enriched by further flavouring and active substances.

The aerosol generating zone 12 contains in the outer air-impermeable sheath 22 three elements indicated coaxial with each other, i.e. in the center a cylindrical carrier 24 for the aerosol precursor which is surrounded by a tubular combustion element 26; between the combustion element 26 and the sheath 22 there is also a heat-resistant thermally insulating tubular layer 28 of a ceramic material or glass fibres serving for thermal shielding of the combustion element 26 with respect to the outside.

The carrier 24 consists of a porous ceramic material and is impregnated with the aerosol precursor, possibly also enriched with tobacco material, for example as strewn-in granulate, fibres or the like.

The tubular combustion element 26 consists of activated carbon, in particular prepyrolized plant material, and comprises on the ignition side, on the left according to the illustration of FIG. 1, passages, in particular bores 30, which extend from the left end wall of the tubular combustion element 26 into the interior thereof.

Said bores may be made as blind bores or also extend over the entire axial length of the combustion element 26, thereby creating additional ventilation.

Alternatively or additionally to the passages or bores in the combustion element flow passages can also be created by a corresponding surface structure of combustion element 26 and/or carrier 24, for example by a corrugated, serrated or stepped outer or inner wall structure of the combustion element 26 and/or carrier 24.

As can be seen from FIG. 1, the cylindrical carrier 24 extends at its mouth end somewhat beyond the combustion element 26; this overhang should at the most have a length of 10 mm.

The right end face of the combustion element 26 according to the illustration of FIG. 1 is provided with a seal 34 and is thus air-impermeable. The magnitude of said seal is set depending on the desired smoke conditions, i.e. it may be a complete seal or a partial seal so that some air can still flow from the combustion element 26 into the intermediate zone 14.

When this smokable article is smoked, the ignition end, on the left in the illustration of FIG. 1 and possibly projecting 1 to 2 mm, is ignited so that the combustion element 26 and thus also the carrier 24 are heated up by thermal conduction as well as by radiation heat.

If the smoker now draws at the mouthpiece 16 air is sucked in the direction of the arrows 32 through the combustion element 26 and the carrier 24. At the same time the heated carrier 24 gives off the aerosol formed so that the corresponding aromatic substances are entrained by the heated air. The air thus flows both axially through the carrier 24 and additionally through the combustion element 26 and then in the direction of the arrows 36 out of the combustion element 26 into the carrier 24 and finally in the direction of the arrows 34 leaves the carrier 24 and enters the interior of the intermediate zone 14; from the intermediate zone 14 the heated air charged with the aromatic substances passes via the mouthpiece into the mouth of the smoker.

If necessary the tipping paper 20 may also be ventilated as is known in conventional cigarettes.

Figure 2:
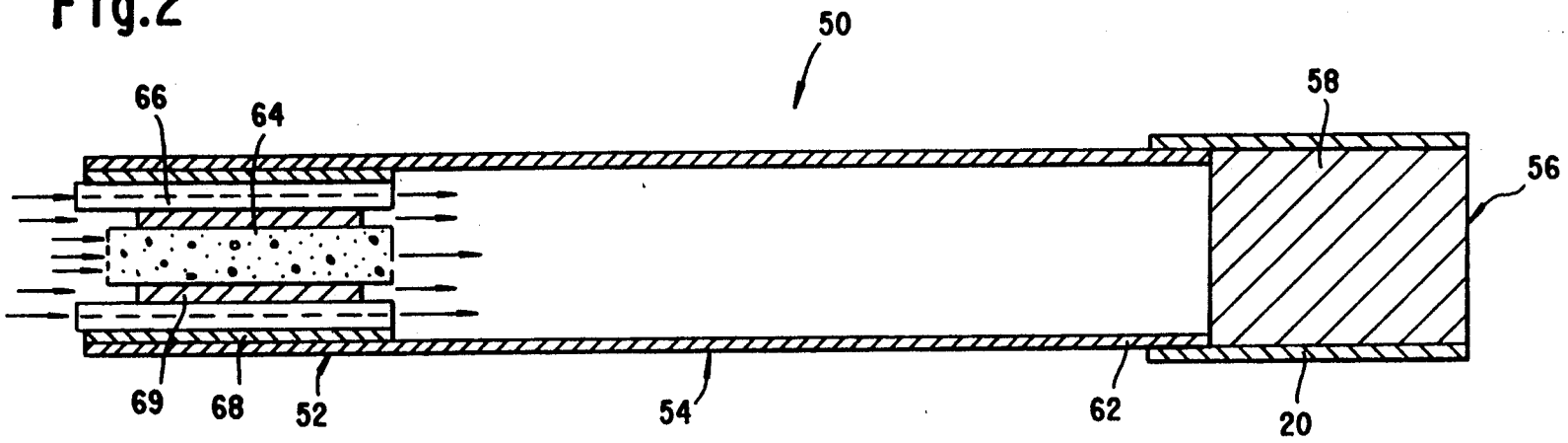
FIG. 2 shows in longitudinal section an overall view of a second embodiment of a smokable article and FIG. 3 shows a radial section through the aerosol generating zone of the second embodiment according to FIG. 2.
Figure 3:
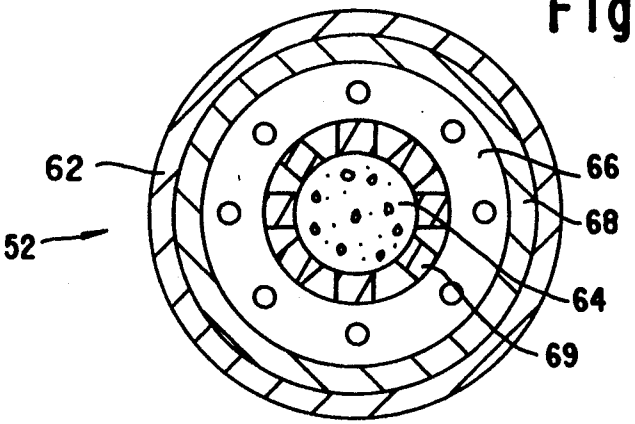

FIGS. 2 and 3 show an embodiment of a smokable article 50 having the same basic structure, i.e. aerosol generating zone 52, intermediate zone 54 and mouthpiece 56. In this case, the outer sheath 62 of the aerosol generating zone 52 and the intermediate zone 54 may consist either of a gas-impermeable material, such as paper, plastic, cardboard or a hollow cylinder of tobacco material or ceramic, or alternatively of a material with low permeability, i.e. low porosity. Possible for this purpose are paper, cardboard, plastic or a hollow cylinder of tobacco material or ceramic, for example an extruded hollow cylinder of tobacco material.

The mouthpiece 56 may be filled with filter material 58, for example cellulose acetate or polypropylene, and possibly also ventilated.

The intermediate zone 54 may either be empty or filled with tobacco material; if a filling with tobacco material is provided an air or gas-permeable separating layer must be provided between the filling and the aerosol generating zone 52 in order to avoid ignition of the filling by the direct contact with the ignited and thus highly heated combustion element in the aerosol generating zone 52.

Such a separating layer may if necessary also be provided in the embodiment according to FIG. 1.

The aerosol generating zone 52 comprises as the embodiment according to FIG. 1 radially outwardly an insulating layer 68 in which the tubular combustion element 66 with the bores is disposed. In the center of the aerosol generating zone 52 the carrier 64 for the aerosol precursor is arranged and is made as an aroma capsule having a wall of metallic or ceramic material of good thermal conductivity; the aroma capsule 64 is filled with a substrate, in particular a granulate, of metal oxide beads, in particular aluminium oxide beads, which is impregnated with the aerosol precursor. The granulate may consist at least partially of tobacco material, in particular granulated, extruded or biotechnically produced tobacco material.

The aroma capsule 64 comprises on the ignition end, on the left in the illustration of FIG. 2, at least one opening for the induced air and on the right mouth end at least one opening for the exit of the aromatic substances from the aroma capsule into the intermediate zone 54.

Between the aroma capsule 64 and the combustion element 66 spacers 69 with longitudinal axial air passages are disposed which keep the inner surface of the combustion element 66 at a predetermined distance from the outer surface of the aroma capsule 64 so that between these two surfaces air flow passages 70 are formed. The spacers 69 are made from metal or thermally conductive ceramic, preferably integrally as part of the wall of the aroma capsule 64.

Figure 4:
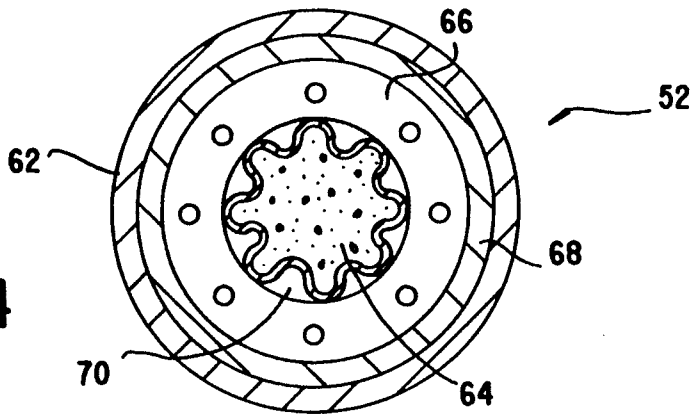
FIG. 4 shows a sectional view of another embodiment.

Said flow passages may also be formed by corresponding configuration of the inner surface of the combustion element 66 and/or of the outer surface of the aroma capsule 64, for example by corrugated, serrated or stepped wall configurations, as shown in FIG. 4.

As can be seen in FIG. 2 the aroma capsule 64 may be off-set somewhat inwardly with respect to the left end side of the combustion element 66.

As already described, after ignition of the combustion element 66 air is drawn in by the smoker; said air flows both through the porous combustion element 66 and through the flow passages between the combustion element 66 and the aroma capsule 64 as well as through the aroma capsule 64 as indicated by the arrows; the aroma capsule 64 heats up due to thermal conduction, as well as heat of radiation, so that the aromatic substances are liberated, entrained by the heated air and finally inhaled by the smoker.

The dimensioning of the draw resistances of the individual components of the smokable article leads to the desired overall effect with respect to the aerosol formation and aerosol concentration in the inhaled aerosol/air mixture.

We claim:

1. A smokable article having an aerosol generating zone at one end, an intermediate zone, and a mouthpiece at an end opposite the aerosol generating zone, said article comprising:

an annular combustion element at said aerosol generating zone, and a cylindrical carrier for an aerosol precursor disposed centrally coaxially in said combustion element with a space therebetween, and connected thereto for heat transfer, said combustion element being externally surrounded coaxially by an insulating layer;

an outer sheath surrounding said insulating layer and connecting said aerosol generating zone with said mouthpiece to form a cavity therebetween at said intermediate zone;

wherein air flow passages are formed in said aerosol generating zone in said space between said cylindrical carrier and said combustion element extending to said cavity, said cylindrical carrier being impregnated with said aerosol precursor, such that aerosols generated by heat of said combustion element when ignited may be drawn to said mouthpiece by air passing through said air flow passages and said cavity.

2. A smokable article according to claim 1, wherein said cylindrical carrier is formed of one of a material selected from the group consisting of metallic and ceramic materials of good thermal conductivity, said carrier being formed as an aroma capsule filled with a substrate impregnated with said aerosol precursor.

3. A smokable article according to claim 1, wherein said cylindrical carrier projects from said aerosol generating zone up to 10 mm into said cavity.

4. A smokable article according to claim 1, wherein said combustion element consists of activated charcoal and projects at an ignition end thereof about 2 mm from said article at said aerosol generating zone end.

5. A smokable article according to claim 4, wherein said combustion element has bores at a projecting ignition end face which extend into the interior thereof.

6. A smokable article according to claim 1, wherein said insulating layer comprises at least one of a material selected from the group consisting of ceramic material and glass fibers.

7. A smokable article according to claim 2, wherein said substrate comprises metal oxide beads.

8. A smokable article according to claim 2, wherein said substrate comprises tobacco material.

9. A smokable article according to claim 1, wherein said combustion element is provided with at least a partial sealing means at an end adjacent said cavity.

10. A smokable article according to claim 1, wherein said cavity is filled with a tobacco material of low packing density.

11. A smokable article according to claim 1, wherein a gas-permeable separating layer is provided between said aerosol generating zone and said cavity.

12. A smokable article according to claim 1, wherein said air flow passages are formed by spacers.

13. A smokable article according to claim 12, wherein said spacers are formed integrally, as part of said cylindrical carrier, of a material selected from the group consisting of metals and thermally conductive ceramics.

14. A smokable article according to claim 1, wherein said air flow passages are formed by configuration of at least one of an outer wall of said cylindrical carrier and an inner wall of said combustion element.

15. A smokable article according to claim 1, wherein said mouthpiece is filled with a filter material.

* * * * *